US005529729A

United States Patent [19]

Eitel

[11] Patent Number: 5,529,729

[45] Date of Patent: Jun. 25, 1996

[54] PROCESS FOR PRODUCING THE REFRACTORY LINING OF A CASTING LADLE

[75] Inventor: Wilhelm Eitel, Ratingen, Germany

[73] Assignee: Intocast GmbH Feuerfestprodukte und Giesshilfsmittel, Ratingen, Germany

[21] Appl. No.: 36,114

[22] Filed: Mar. 23, 1993

[51] Int. Cl.[6] ..... B32B 35/00; F27D 1/16

[52] U.S. Cl. ..... 264/30; 264/35; 264/36

[58] Field of Search ..... 264/30, 36, 35

[56] References Cited

U.S. PATENT DOCUMENTS

| | | | |
|---|---|---|---|
| 3,963,815 | 6/1976 | Ezaki et al. | 264/30 |
| 4,923,180 | 5/1990 | Eitel | 266/44 |

FOREIGN PATENT DOCUMENTS

| | | | |
|---|---|---|---|
| 3433123 | 11/1986 | Germany . | |
| 1-195240 | 8/1989 | Japan | 264/30 |
| 2122532 | 1/1984 | United Kingdom . | |

OTHER PUBLICATIONS

Wasmuht, "Das Stranggiessen Von Stahl," *Stahleisen--Schriften,* Heft 8, 1975, pp. 56–59.

Mafune et al., "Recent Process on Monolithic Refractories and Installation Methods in Japan," *Journees d'Information Techniques . . . des Produits & Materiaux Refractaires,* 1985.

Szezesny et al., "Bottom Inert Gas Blowing into an Electric Arc Furnace at Vallourec," *Metallurgical Plant and Technology International,* 1990, pp. 54–61.

*Primary Examiner*—Karen Aftergut
*Attorney, Agent, or Firm*—Foley & Lardner

[57] ABSTRACT

A process for producing an inner refractory lining of a ladle or metallurgical vessel for casting steel. The inner refractory lining incorporates wall passages with conical nozzle bricks and/or bubble bricks. The inner lining is produced by using a thixotropic vibrational lining mass. Templates are employed to maintain openings for the wall passages during production of the inner lining. After the inner lining is produced, the templates are removed from the inner lining. Once the templates are removed from the inner lining, the conical nozzle bricks and/or the bubble bricks are inserted into the openings. Each of the bricks is mortared into an opening without using seating blocks. The bricks are mortared into the openings so that the bricks remain free from contact with the inner lining.

9 Claims, 1 Drawing Sheet

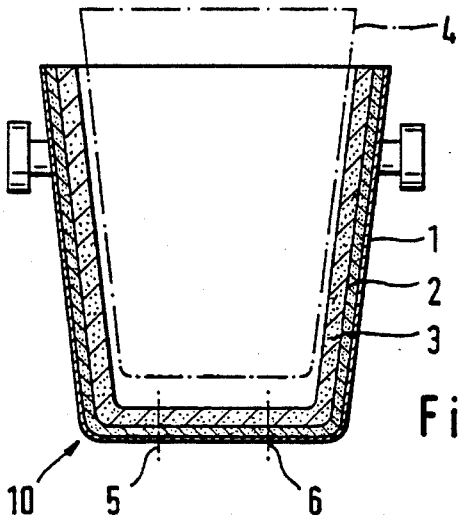
Fig.1
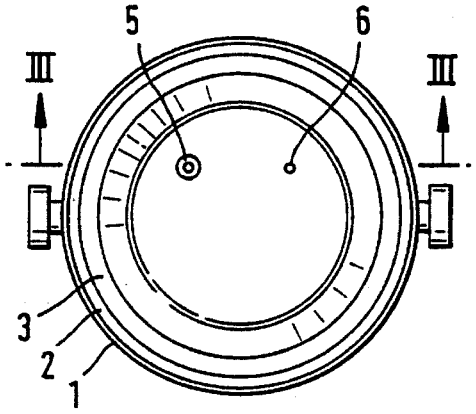
Fig.2
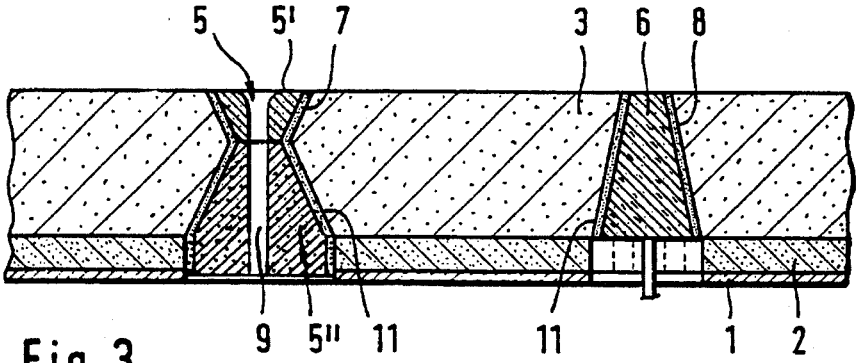
Fig.3
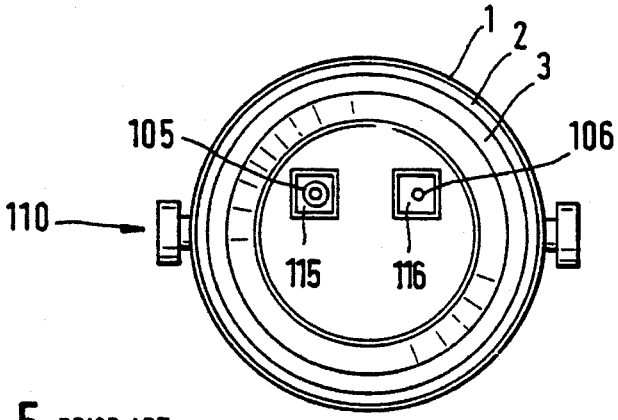
Fig.4
PRIOR ART
Fig.5 PRIOR ART
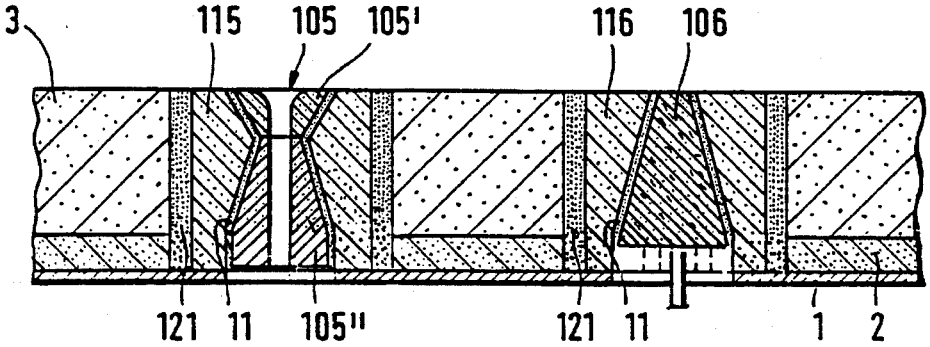

PROCESS FOR PRODUCING THE REFRACTORY LINING OF A CASTING LADLE

BACKGROUND OF THE INVENTION

The invention relates to a process for producing a refractory lining of a ladle or metallurgical vessel for casting steel. The refractory lining also serves as the inner (wear) lining for the ladle or metallurgical vessel. The inner lining is produced by using a thixotropic vibrational lining mass. The lining incorporates wall passages with conical nozzle bricks and/or bubble bricks. Each of the bricks is mortared into an opening without using seating blocks. The bricks are mortared into the openings so that the bricks remain free from contact with the inner lining.

The fundamentals of such a process form part of the state of the art, owing to a paper read by T. Mafune and M. Chastant on Oct. 29 and 30, 1985, in Nancy at the meeting "Journeès d'Information Techniques de Mise en Oeuvre des Produits & Materìaux Refractaires [Technical Information Days about the Use of Refractory Products and Materials]". It is also discussed in DE-C-3,741,073. The difference between this type of lining and the conventional brick-lining with refractory bricks is that the lining is formed as a monolithic block. The lining is produced in such a way that a template defining the clear opening of the ladle is lowered into the latter and the interspace between the inner ladle wall and the template is filled with a thixotropic refractory mass which, under the action of vibrators, flows readily and is compacted. If the lining is worn after a number of ladle campaigns, repair can be effected in a relatively simple manner by applying new thixotropic refractory mass with the aid of the template, after the surface layer of the old lining has been removed, as described in DE-C-3,741,073.

The aims are to extend the service life of such a lining for as long as possible without repairs which interrupt the sequence of operation. In fact, the ladles and the metallurgical processes to be carried out in them have gained increasing importance in modern metallurgy. In particular, the so-called ladle furnace now plays a decisive part in steel production. The ladle is equipped with bottom bubble bricks and a cover with three arc electrodes for heating and bubbling gas through the molten steel. The electric arc furnace and the oxygen top-blowing converter have become simply melting-down units. In the ladle furnace, however, the steel is adjusted, alloyed, correction-alloyed and brought to an exact temperature, so that the important cost-saving sequential cast in continuous casting can be ensured. The ladle furnace is thus an important vessel in modern steel production and must be absolutely reliable and safe. Every melt exerts an erosive attack on the lining. A particular problem is represented here by the perforated bricks and bubble bricks, i.e. the bricks in the region of the tapping hole and in the region of the points where gases are blown from the outside into the molten steel in the ladle.

The hitherto usual technique at such wall passages of the ladle is to insert the actual nozzle bricks, i.e. bush-like elements of particularly high-grade refractory material, and bubble bricks, i.e. porous bricks of in most cases conical shape for blowing in gaseous media, into special seating bricks, i.e. bricks which are in turn seated in the lining and receive the nozzle bricks or bubble bricks in a central perforation. "nozzle bricks and/or bubble bricks" are thus meant to be the actual functional bricks which come into contact with the melt running out and/or with the gas blown in, and "seating bricks" are meant to be separate bricks which are inserted into the surrounding lining and form the fixing for the abovementioned bricks. For the nozzle brick of the tapping hole or spout this technique is evident from Stahleisen-Schrift, Issue No. 8 "Das StranggieBen von Stahl [Continuous Casting of Steel]", published by Stahleisen GmbH (Düsseldorf 1975), page 58, and for bubble bricks from GB-A-2,122,532. The seating bricks were, in conventional brick-lining, a constituent of the refractory masonry and are inserted, during the production of the lining from vibrational masses, into openings thereof kept free by means of templates.

Under the erosive action of the melt, these seating bricks wear out in most cases at increasing rates. In such a case, the ladle had hitherto to be cooled, so that the bricks could be broken out and replaced by new ones. Troublesome interruptions in operation were the consequence.

The technique of inserting the actual nozzle bricks and/or bubble bricks into separate seating bricks has always been retained, in spite of the associated inconveniences due to the wear of the seating bricks. This also applies to-the time after the development of the monolithic linings. The bricks were present, unchanged, even in rectangular shape, which is a relic from the period of bricked linings.

This also applies to the teaching according to DE-B-2, 233,894, which relates to the lining of a metal-lurgical vessel with a lining mass which can be made to flow by vibration but is not thixotropic. The runner brick, which can be vibrated into the lining mass or can be inserted later, after the introduction of the mass, into a region kept free at that time, is drawn diagrammatically as a unitary body, but it consisted in fact of a seating brick and nozzle brick in accordance with the then current technique.

The blowing brick according to DE-C2-3,433,123 is cased in its lower region with a metal sheet and, in its upper region, directly adjoins the lining of the ladle and, after the ladle has been put into operation, its surface sinters together with the lining, whose type is not described. It forms a unit with the lining and cannot be replaced without major breaking-out work.

The literature reference "Bottom inert gas blowing into an electric arc furnace at Vallourec" in "Metallurgical Plant and Technology International", 6 (1990), pages 54–61, discloses an electric arc furnace, in which a blowing brick of MgO is tamped directly into an MgO lining and bonds with the latter under the action of the melt to form a unit.

A replacement of the bricks in the abovementioned embodiments is made-particularly difficult by their cylindrical shape in the region adjacent to the lining, which shape makes it virtually impossible, in conjunction with the direct sintering together with the surrounding lining, to eject the brick residues.

SUMMARY OF THE INVENTION

The invention is based on the object of increasing the durability, economics and safety of the lining of steel-casting ladles.

This object is achieved by the invention for producing a refractory lining of a ladle or metallurgical vessel for casting steel. The refractory or inner lining is produced by using a thixotropic vibrational lining mass. The refractory lining incorporates wall passages with conical nozzle bricks and/or bubble bricks. Templates are employed to maintain openings for the wall passages during production of the inner lining.

After the inner lining is produced, the templates are removed. Once the templates are removed from the inner lining, the conical nozzle bricks and/or the bubble bricks are inserted into the openings. Each of the bricks is mortared into an opening without using seating blocks. The bricks are mortared into the openings so that the bricks remain free from contact with the inner lining.

The result of this is that the problems, associated with the seating bricks, in the form of premature wear are overcome. Thus, not only are the seating bricks dispensed with, but further considerable gains are also obtained due to the avoidance of interruptions in operation.

In place of the seating bricks, which are also called perforated bricks or runner bricks at the spout, only small templates for the functional bricks themselves, i.e. for the nozzle brick forming the casting nozzle and for the conical bubble brick, are placed according to the invention in the thixotropic vibrational lining of the ladle. The bottom of the lining of the ladle is cast and vibrated, and the templates are then pulled out. After the lining has dried, only the bush-like nozzle brick and the bubble brick are inserted into the remaining openings, and the joint is sealed with refractory mortar. This step was also necessary when the nozzle bricks or bubble bricks were inserted into the seating bricks. These seating bricks themselves and their joining with the surrounding lining by mortar are, however, now superfluous. Due to the reduction in joints, which have a poor erosion resistance, and in the corresponding bricks, the risk of a breakthrough is reduced. Of course, this also leads to a considerable saving in time and costs, and the service life of the ladle lining increases markedly. In trials, service lives of more than 150 ladle campaigns have already been achieved with ladles according to the invention, before it was necessary to renew the lining.

At the end of the service life, the surface of the lining is roughened at the bottom and at the wall, and a thin layer thereof is removed true to the relief, and a worn nozzle brick and/or such a bubble brick can, because of its conicity, be relatively easily ejected, since it becomes detached along the mortar layer. After the opening has been cleaned, the small templates for the particular nozzle brick or bubble brick and subsequently the large template corresponding to the clear opening of the ladle are re-inserted. The interspace between the "old surface" and the template is filled with thixotropic refractory mass. After the vibration, mortaring-in of the new bricks and drying, a ladle as new with a monolithic lining is obtained, as is described in DE-C-3,741,073. Owing to the omission of the joints and of the additional bricks, the novel lining is significantly more resistant to erosion and more durable in the region of the nozzle bricks than in the case of the prior art.

BRIEF DESCRIPTION OF THE DRAWINGS

An illustrative embodiment of the invention is diagrammatically represented in the drawing, in which:

FIG. 1 shows a section through the axis of a casting ladle for casting steel, FIG. 2 shows a view from above into the ladle on an enlarged scale, FIG. 3 shows a section through the bottom of the ladle along the line III—III in FIG. 2, and FIGS. 4 and 5 show, for comparison with FIGS. 2 and 3, corresponding views of a ladle according to the prior art.

DESCRIPTION OF THE PREFERRED EMBODIMENT

The ladle 10 shown in FIG. 1 comprises a pot-shaped casing 1 of strong steel sheet, which has an internal height of a few meters and can take up to 400 tonnes of molten steel. The casing 1 is provided on the inside with a permanent lining 2, which is laid in bricks in the illustrative embodiment but can, under certain circumstances, also be cast, of refractory material which is not reached by the melt. On the inside, the permanent lining 2 is covered by the so-called wear lining 3 which forms the surface facing the melt. The shape of this surface is formed by a conical template 4 which is reproduced in dots and dashes in FIG. 1 in a state already partially lifted out of the ladle 10. During the original lining and during the subsequent repair linings after the removal of damaged surface layers of the substrate and after appropriate roughening, the template 4 is lowered into the ladle 10 and the interspace between the lining remaining in the ladle 10 and the template is filled with thixotropic casting mass which is compacted by vibrators fitted to the template, to give a monolithic lining.

The bricks only indicated in FIG. 1, namely the nozzle brick 5 and a bubble brick 6, can be seen in FIG. 2 in the view from above.

In FIG. 3, the nozzle brick 5 and the bubble brick 6 are illustrated in a side view. In the illustrative embodiment shown, openings 7, 8 are provided in the wear lining 3, which openings have been recessed during the production or repair of the wear lining 3 by means of templates. The opening 7 is double-conical, corresponding to the shape of the nozzle brick 5 for the spout, which consists of two cones 5' 5" with the tapered sides facing one another and with a central spout opening 9. The opening 8 is, corresponding to the shape of the conical bubble brick 6, singly conical and tapers towards the interior of the ladle The bricks 5' 5" and 6 are cemented into the openings 7, 8 of the wear lining 3 by means of refractory mortar 11. The mortar 11 thus joins the bricks directly to the surrounding monolithic wear lining 3.

For comparison, the prior state of the art is indicated in FIGS. 4 and 5. The nozzle brick 105 for the spout, consisting of the conical parts 105' and 105", and the bubble brick 106 were seated, cemented in by means of refractory mortar 11, in separate seating bricks, namely the so-called perforated brick 115 which received the nozzle brick 105, and the seating brick 116 which received the bubble brick 106. The bricks 115, 116 were in turn fixed by means of refractory mortar 121 in the surrounding monolithic lining 3. The bricks 115, 116 which, with their Joints receiving the refractory mortar 121, provided points of attack for the erosion by the melt, can be omitted in the invention.

I claim:

1. A process for producing a refractory lining of a ladle used for casting steel, the refractory lining incorporating wall passages with at least one conical nozzle brick and bubble brick, comprising:

producing an inner lining for the ladle by using a thixotropic vibrational lining mass;

maintaining openings in the inner lining by employing templates to form passages for the at least one conical nozzle brick and bubble brick during production of the inner lining mass;

inserting the at least one conical nozzle brick and bubble brick into the openings; and mortaring the at least one conical nozzle brick and bubble brick into the inner lining without seating blocks so that the at least one conical nozzle brick and bubble brick remains free from contact with the inner lining so that the at least one conical nozzle brick and bubble brick is readily removable from the inner lining without causing break-out of the inner lining due to the at least one conical nozzle brick and bubble brick remaining free from contact with the inner lining.

2. A process for producing a refractory lining of a metallurgical vessel, comprising:

maintaining at least one opening for a wall passage in an inner lining of the metalurgical vessel by placing at least one template in the metallurgical vessel;

forming the inner lining of the metallurgical vessel by using a thixotropic vibrational casting mass; and mortaring at least one brick directly into the at least one opening without a seating block so that the at least one brick is readily removable from the inner lining without causing break-out of the inner lining due to the at least one brick remaining free from contact with the inner lining during mortaring of the at least one brick.

3. The process for producing a refractory lining of a metallurgical vessel as recited in claim 2, further comprising placing the at least one template into an existing opening for a wall passage.

4. The process for producing a refractory lining of a metallurgical vessel as recited in claim 2, further comprising placing two templates in the metallurgical vessel in order to provide two openings for two wall passages.

5. The process for producing a refractory lining of a metallurgical vessel as recited in claim 4, further comprising placing one conical template and one bubble template.

6. The process for producing a refractory lining of a metallurgical vessel as recited in claim 1, further comprising mortatring two bricks into two openings.

7. The process for producing a refractory lining of a metallurgical vessel as recited in claim 6, further comprising mortaring a conical nozzle brick and a bubble brick.

8. The process for producing a refractory lining of a metallurgical vessel as recited in claim 2, wherein the process of forming the inner lining by using a thixotropic vibrational casting mass includes preparing an original inner lining.

9. The process for producing a refractory lining of a metallurgical vessel as recited in claim 2, wherein the process of forming the inner lining by using a thixotropic vibrational casting mass includes repairing an existing inner lining.

* * * * *